US009779705B2

(12) United States Patent
O'Daly

(10) Patent No.: US 9,779,705 B2
(45) Date of Patent: Oct. 3, 2017

(54) MUSICAL SOUND GENERATOR

(71) Applicant: ELBY INNOVATION LIMITED, Glenfield, Auckland (NZ)

(72) Inventor: Liam Bryan O'Daly, Auckland (NZ)

(73) Assignee: ELBY INNOVATION LIMITED, Glenfield (NZ)

( * ) Notice: Subject to any disclaimer, the term of this patent is extended or adjusted under 35 U.S.C. 154(b) by 0 days.

(21) Appl. No.: 15/302,243

(22) PCT Filed: Apr. 14, 2015

(86) PCT No.: PCT/NZ2015/000026

§ 371 (c)(1),
(2) Date: Oct. 6, 2016

(87) PCT Pub. No.: WO2015/160264

PCT Pub. Date: Oct. 22, 2015

(65) Prior Publication Data

US 2017/0032771 A1 Feb. 2, 2017

(30) Foreign Application Priority Data

Apr. 14, 2014 (NZ) ..... 623827
Sep. 11, 2014 (NZ) ..... 631221

(51) Int. Cl.
*G10F 1/08* (2006.01)
*A63H 5/00* (2006.01)
(Continued)

(52) U.S. Cl.
CPC ..... *G10F 1/08* (2013.01); *A63H 5/00* (2013.01); *G10F 5/00* (2013.01); *G10K 1/067* (2013.01); *G10H 2220/021* (2013.01)

(58) Field of Classification Search
CPC ..... G10F 1/08; G10K 1/067; A63H 5/00
See application file for complete search history.

(56) References Cited

U.S. PATENT DOCUMENTS 408,635 A * 8/1889 Sommer ..... A63F 7/3622 446/168
2,254,488 A 9/1941 Miller
(Continued)

OTHER PUBLICATIONS

International Search Report from International Patent Application No. PCT/NZ2015/000026, dated Jun. 24, 2015.
(Continued)

*Primary Examiner* — Robert W Horn
(74) *Attorney, Agent, or Firm* — Greer, Burns & Crain, Ltd.

(57) ABSTRACT

A musical sound generator is provided including a tube defining a resonant cavity, the tube having a plurality of sound producing chimes configured to produce an audible sound when at least one object impacts on at least one of the chimes; a reservoir configured to hold a number of objects; and a transfer mechanism configured to transfer the objects from the reservoir to an elevated position within the resonant cavity, wherein the objects fall down from the elevated position within the resonant cavity by gravity after being transferred by the transfer mechanism, to strike the plurality of sound producing chimes; and wherein the position of the reservoir is configured to be moved depending on the level of the objects held in the reservoir.

12 Claims, 4 Drawing Sheets

(51) Int. Cl.
*G10K 1/067* (2006.01)
*G10F 5/00* (2006.01)

(56) References Cited

U.S. PATENT DOCUMENTS

| | | | | | |
|---|---|---|---|---|---|
| 2,504,457 | A | | 4/1950 | Rundell | |
| 2,522,133 | A | * | 9/1950 | Sanders | A63F 7/2409 273/120 R |
| 2,738,697 | A | | 3/1956 | Miller | |
| 2,895,257 | A | | 7/1959 | Morss | |
| 3,782,729 | A | * | 1/1974 | Ernst | A63F 7/3622 273/138.2 |
| 4,128,964 | A | * | 12/1978 | Ogasawara | A63H 18/00 187/267 |
| 4,844,447 | A | * | 7/1989 | McKnight | A63F 7/02 273/121 B |
| 5,212,331 | A | * | 5/1993 | Waldo | G10D 13/06 84/404 |
| 5,225,616 | A | | 7/1993 | Bakeman | |
| 5,505,114 | A | * | 4/1996 | Lawson | G10K 3/00 84/404 |
| 5,955,125 | A | * | 9/1999 | Hoeting | A23G 3/50 221/24 |
| D437,362 | S | * | 2/2001 | Campbell | D21/406 |
| 7,326,059 | B2 | * | 2/2008 | Habing | G09B 7/02 434/236 |
| 8,648,244 | B2 | * | 2/2014 | Dahl | G10D 13/06 84/402 |
| 2017/0032771 | A1 | * | 2/2017 | O'Daly | A63H 5/00 |

OTHER PUBLICATIONS

Written Opinion for International Patent Application No. PCT/NZ2015/000026, dated Jun. 24, 2015.

* cited by examiner

MUSICAL SOUND GENERATOR

BACKGROUND

The present invention relates generally to a musical sound generator. In particular, the present invention relates to a musical sound generator for generating musical sounds under the force of gravity without intervention by a musician.

One of the benefits of listening to some musical sounds is that it can be calming to the listener both in indoor and outdoor environments and can assist people with getting to sleep. Consequently to have a non-intrusive background noise in an environment can be beneficial to a person occupying that environment such as a health benefit with people suffering from conditions such as autism or tinnitus by providing relief from their symptoms as seen with white noise machines which produce sounds such as a rushing water or bird song. In addition, non-intrusive background noise may also help with masking intrusive background noise such as in a workplace between rooms.

There are a number of known apparatus' which generate random musical sounds over a long time period. One such apparatus is disclosed in U.S. Pat. No. 5,225,616. This document discloses an apparatus with an adhesive strip which delays a number of beads to fall under gravity from an elevated position onto a number of acoustic bars positioned in an orientation configured to randomly generate a number of different musical notes.

A disadvantage with this apparatus is that the adhesive tape is prone to losing its adhesive qualities by drying on exposure with the air and coming into contact with other particles such as dust. The adhesive tape can also leave a residue on the beads that come into contact with them. Both of these disadvantages make the apparatus disclosed in this document less effective over a reasonably short amount of time and would result in the need to service the apparatus regularly to stay in working operation.

In addition, for this apparatus to continue to generate musical notes over an extended period of time, the apparatus has to be periodically turned upside down so that beads which have fallen down to the bottom of the apparatus are now positioned at the top of the apparatus so that they can once again fall through the apparatus to generate further musical notes.

Another known apparatus for producing sound and visual display is disclosed in U.S. Pat. No. 4,844,447. The apparatus comprises a centrally located auger to transfer beads from a reservoir to an elevated position within the apparatus so that they can fall under gravity through a series of acoustic spokes back to the reservoir to be recycled.

A disadvantage with this apparatus is the lack of efficiency of loading the beads by the auger via excessive contact of the objects with the auger which can lead to unwanted noise and a lack of reliability of the apparatus.

Further, there is no means of control on the apparatus of the speed of the falling beads, and therefore the speed of the musical sounds produced.

It is an object of the invention to provide a musical sound generator for that addresses at least some of the problems of the prior art, such as those discussed above.

Alternatively, it is an object of the invention to at least provide the public with a useful choice.

SUMMARY

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

In a first preferred embodiment of the invention there is provided a musical sound generator comprising:

- a tube defining a resonant cavity, the tube comprising a plurality of sound producing chimes configured to produce an audible sound when at least one object impacts on at least one of the chimes;
- a reservoir configured to hold a number of objects; and
- a transfer mechanism configured to transfer the objects from the reservoir to an elevated position within the resonant cavity;
- wherein the objects fall down from the elevated position within the resonant cavity by gravity after being transferred by the transfer mechanism, to strike the plurality of sound producing chimes to generate a continuous cycle of musical sounds at random intervals over time; and
- wherein the position of the reservoir in relation to the transfer mechanism is configured to be moved depending on the level of the objects held in the reservoir to improve uptake of the objects by the transfer mechanism from the reservoir.

Preferably, the objects are plastic beads.

Preferably, the transfer mechanism is a driven belt configured with a plurality of paddles to capture and transfer the objects to the top of the tube.

Preferably, the tube is configured to rotate via a motor.

In this way, the musical sound generator can produce randomized sound and an aesthetically pleasing look via the rotation of the chimes within the resonant cavity of the tube.

Preferably, the position of the reservoir in relation to the transfer mechanism is moved with at least one sensor configured to sense the level of the objects in the reservoir and at least one actuator configured to move the position of the reservoir via input from the at least one sensor.

Preferably, the musical sound generator also comprises an ion generator configured to produce electrostatic charge to the objects and/or reservoir to attract the objects to the transfer mechanism to improve the transfer of the objects by the transfer mechanism.

Preferably, the musical sound generator also comprises a microphone positioned in the resonant cavity to transduce sound to be uploaded and reproduced via at least one speaker.

Preferably, wherein the musical sound generator also comprises at least one LED configured to illuminate the resonant cavity when one of the chimes is struck by one of the objects.

Further aspects of the invention, which should be considered in all its novel aspects, will become apparent to those skilled in the art upon reading of the following description which provides at least one example of a practical application of the invention.

BRIEF DESCRIPTION OF THE DRAWINGS

The invention will now be described by way of example only and with reference to any one of the accompanying drawings in which.

DETAILED DESCRIPTION

In a preferred form of the present invention, an apparatus for a musical sound generator is generally indicated by arrow 100.

Figure 1:
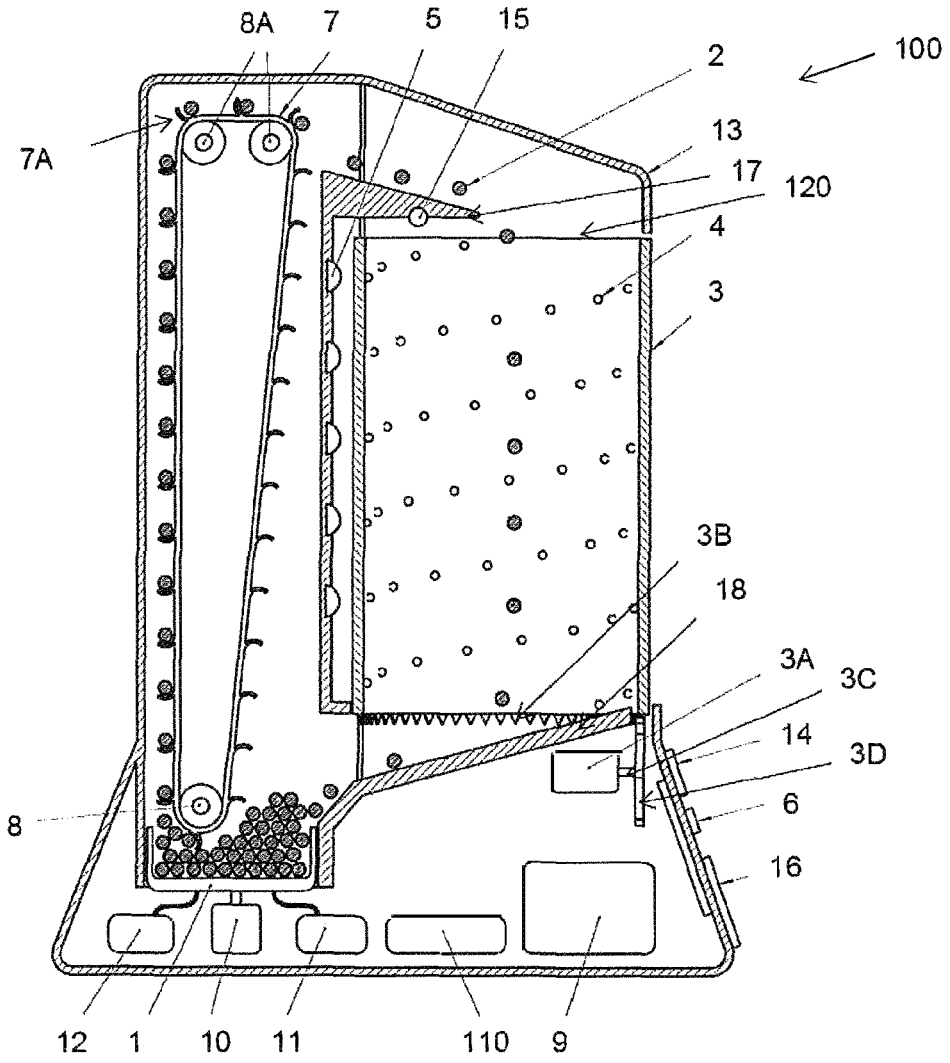
FIG. 1 shows a sectional view of a preferred embodiment of the present invention in the form of a musical sound generator.
Figure 2:
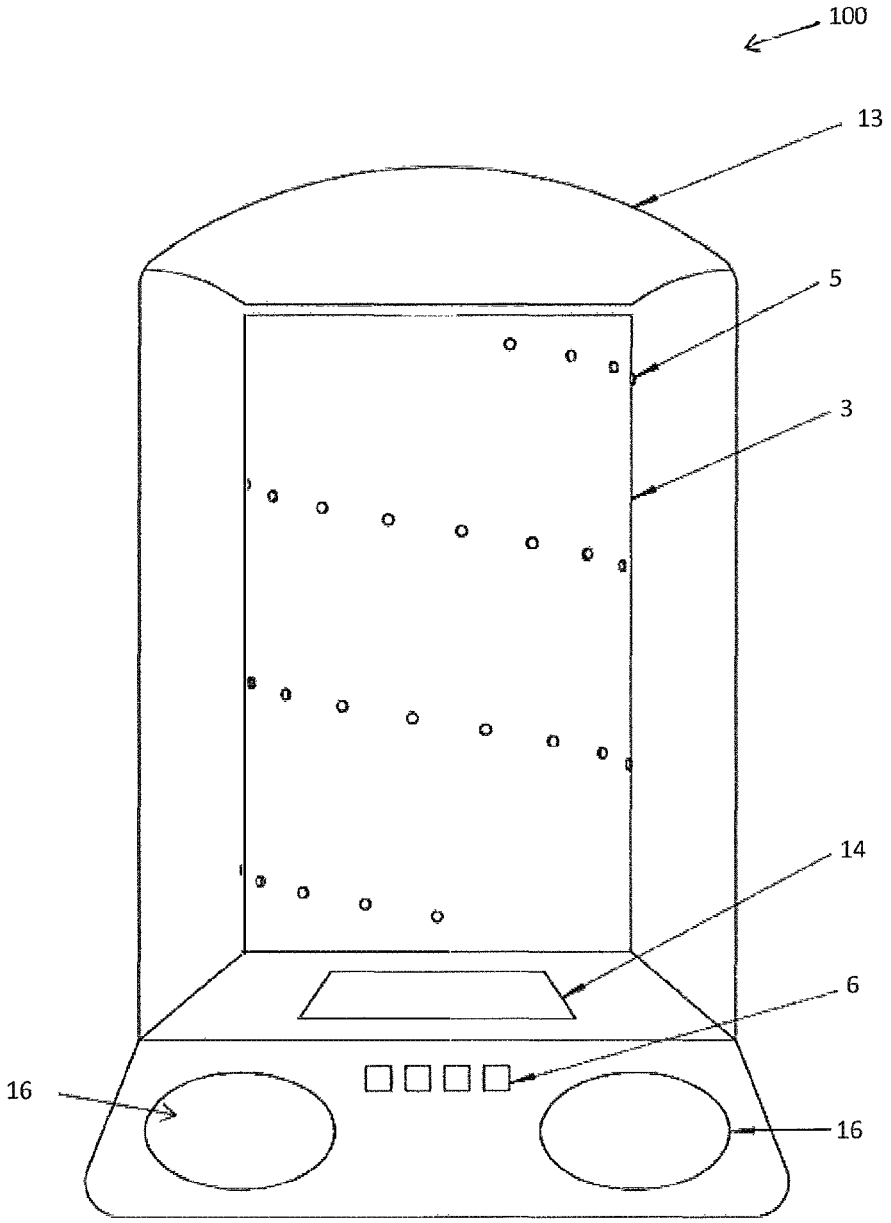
FIG. 2 shows a front view of the preferred embodiment shown in FIG. 1.

Referring to FIGS. 1 and 2, the musical sound generator (100) comprises a reservoir (1) at the bottom of the apparatus (100) and configured to hold a number of solid objects in the form of plastic beads (2); a resonant cavity defined by a tube (3) and comprising a plurality of sound producing chimes (4) positioned on an internal surface of the tube (3) and configured to produce an audible sound when the plastic beads (2) impact on at least one of the chimes (4) and the tube (3) is rotated via a motor (3A). The speed of rotation of the tube (3) via the motor (3A) can be adjusted by the user via a control button (6) to produce a randomized sound and produce an aesthetically pleasing look via the rotation of the chimes (4) with the tube (3). A ring gear (36) is configured via a shaft (3C) and gear (3D) to enable rotation of the tube (3) via the motor (3A).

The apparatus (100) includes at least one light emitting diode (LED; 5) configured to illuminate the resonant cavity of the tube (3). The light output of the LEDs (5) can be electronically controlled by the user with at least one control button (6). The LED lights (5) can be used to illuminate and project still or motion images directly onto the tube (3). The chimes (4) may optionally have an associated electronic control circuit in the control unit (110) configured to illuminate the LED's (5) when a chime (4) is struck by the beads (2).

The musical sound generator (100) comprises a transfer mechanism in the form of a belt (7) driven by a motorised pulley (8) and facilitated in its movement via a pair of upper belt pulleys (8A). The belt (7) comprises a number of paddles (7A) configured to collect and transfer the beads (2) from the reservoir (1) to the top of the apparatus (100), wherein the beads fall down into the open end (120) of the tube (3) to the bottom of the tube (3) by gravity, to strike the chimes (4) and in doing so generates a continuous cycle of musical sounds at random intervals over time. The motorized pulley (8) is driven from an electricity supply (9) such as a battery. The height of the reservoir (1) can be adjusted electronically via an actuator in the form of a reservoir lift solenoid (10) which is controlled to move towards the belt (7) by a reservoir sensor (11), such as a light photo-detector, and the control unit (110) when the level of the beads (2) in the reservoir (1) falls below a predetermined level to pick up the beads (2) by the paddles (7A), or move away from the belt (7) to reduce unwanted noise from excessive contact of the belt (7) with the beads (2) if the level of the beads (2) is too near the belt (7).

The apparatus (100) also comprises an ion generator (12) to produce negative ions to purify or condition the air surrounding the apparatus (100). In addition, the ion generator (12) can be used to provide electrostatic charge to the reservoir (1) and/or the beads (2) to either attract beads (2) onto the conveyer belt (7) and/or agitate the beads (2) in the reservoir (1) to improve the loading efficiency of the beads (2) and/or reduce friction of loading of the beads (2) and therefore unwanted noise from the beads (2) contacting the belt (7).

The apparatus (100) has a cover (13) configured to fit over the tube (3) and conveyer belt (7) to prevent debris such as dust falling in. The cover (13) of the apparatus (100) could be styled in an aesthetically pleasing form in different materials such organic wood or more modern Perspex. For example a clear exterior cover would show the internal movement and workings within the device which would add to the calming effect of the apparatus (100) by stimulating visual interest in the user.

The apparatus (100) has an LCD display (14) to display the settings of the apparatus (100) such as speed of rotation of the tube (3) and the speed of the belt (7).

The apparatus (100) has a microphone (15) positioned in the tube (3) to capture the acoustic sound from the chimes (4) being struck by the beads (2) to be reproduced through a pair of speakers (16). The apparatus (100) may also optionally comprise a sound effects unit and amplifier (not shown) to adjust the acoustic sound produced by the sound producing chimes and recorded by the microphone (15), and produce sound effects such as reverberation, delay and/or distortion to be reproduced through the speakers (16). This microphone may optionally have an associated electronic circuit (not shown) configured to illuminate the LED's (5) when sound is reproduced by the speakers (16). A shelf (17) delivers the beads (2) from the top of the belt (7) to the top of the tube (3). After passing through the tube (3) the beads (2) impact on a base (18) which re-delivers the beads (2) to the reservoir (1).

A further optional feature is an alarm clock and radio (not shown) as well as an audio in and USB/Bluetooth connections (not shown) for charging an external electrical device and receiving in audio and video signals.

The apparatus (100) could be sold as a complete unit or as a kit of parts for easy assembly.

Figure 3:
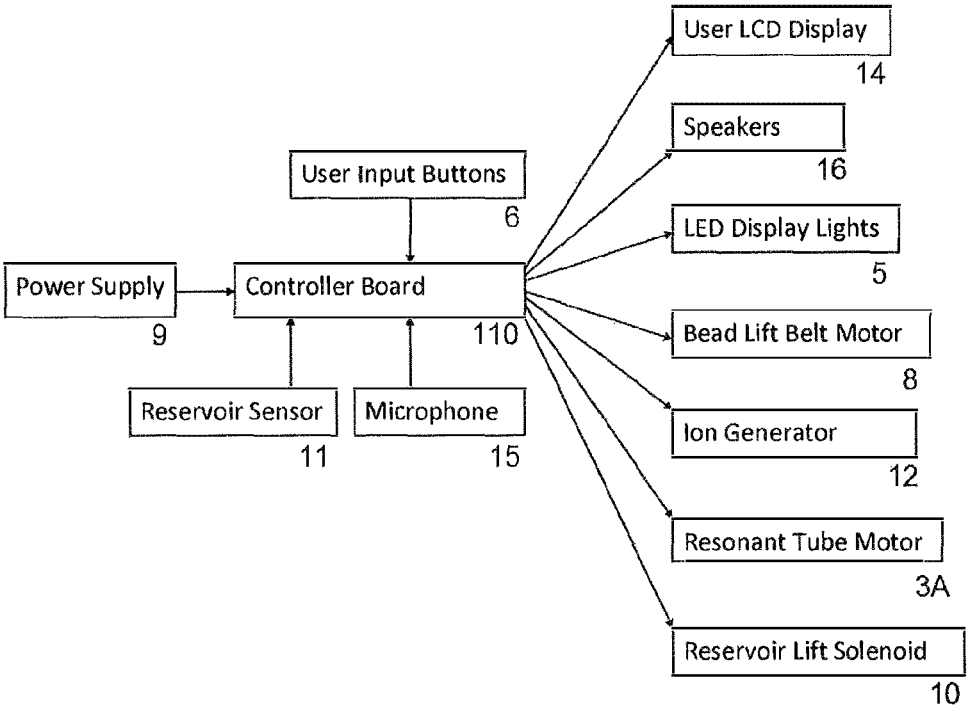
FIG. 3 shows a flow chart of the features of the preferred embodiment shown in FIG. 1.

Referring to FIG. 3, the power supply (9) produces electricity to the controller board (110). Inputs in the form of the user input buttons (6), reservoir sensor (11) and microphone (15). The control board (110) produces outputs in the form of user LCD display (14), speakers (16), LED display lights (5), bead lift belt motor (8), ion generator (12), resonant tube motor (3A) and reservoir lift solenoid (10).

The apparatus (100) continuously produces random musical notes of a good tonal quality over an extended period of time without human intervention and can be powered by a power source such as a battery and/or by a mains electricity source. The apparatus (100) is intended to create a pleasant and relaxing ambience to a space in both an aesthetic and audible manner for both indoor and outdoor environments. The apparatus (100) could be positioned in different outdoor and indoor spaces such as a lounge, bedroom, bathroom, waiting room, therapy or treatment rooms or outdoor gardens.

It will be understood that various modifications may be made without departing from the embodiments provided by the invention. For example, the sound producing chimes could also take the form of rods that produce musical notes when struck by the objects under gravity. The transfer mechanism could also take the form of actuators such as spring-loaded pistons configured to push the objects up tubes to an elevated position within the resonant cavity. Alternatively, the transfer mechanism can utilise pressurized air or liquid to propel the objects to the elevated position within the resonant cavity. In further alternative embodiments the transfer mechanism may be another means, process or other way of causing the beads to move to the top of the apparatus after falling through the resonant cavity.

Optionally the musical sound generator may also comprise an ornamental water display selected from the group consisting of: a fountain, pool, cascade, waterfall, and stream to add further visual and acoustic quality to the apparatus of the present invention.

Embodiments of the present invention may offer any one or more of the following notable advantages:

- improved sound quality in random musical sound generation;
- a higher level of user control of the frequency of the musical sounds and sonic characteristics of these sounds;
- improved entertainment experience for the user in the form of a combination of sounds, visual experience and acoustic quality; and
- improved efficiency and quieter operation of transportation of sound producing objects from the bottom to the top of the resonant cavity; and
- reduction in wear on the sound producing objects through lower friction levels during their transportation.

Figure 4:
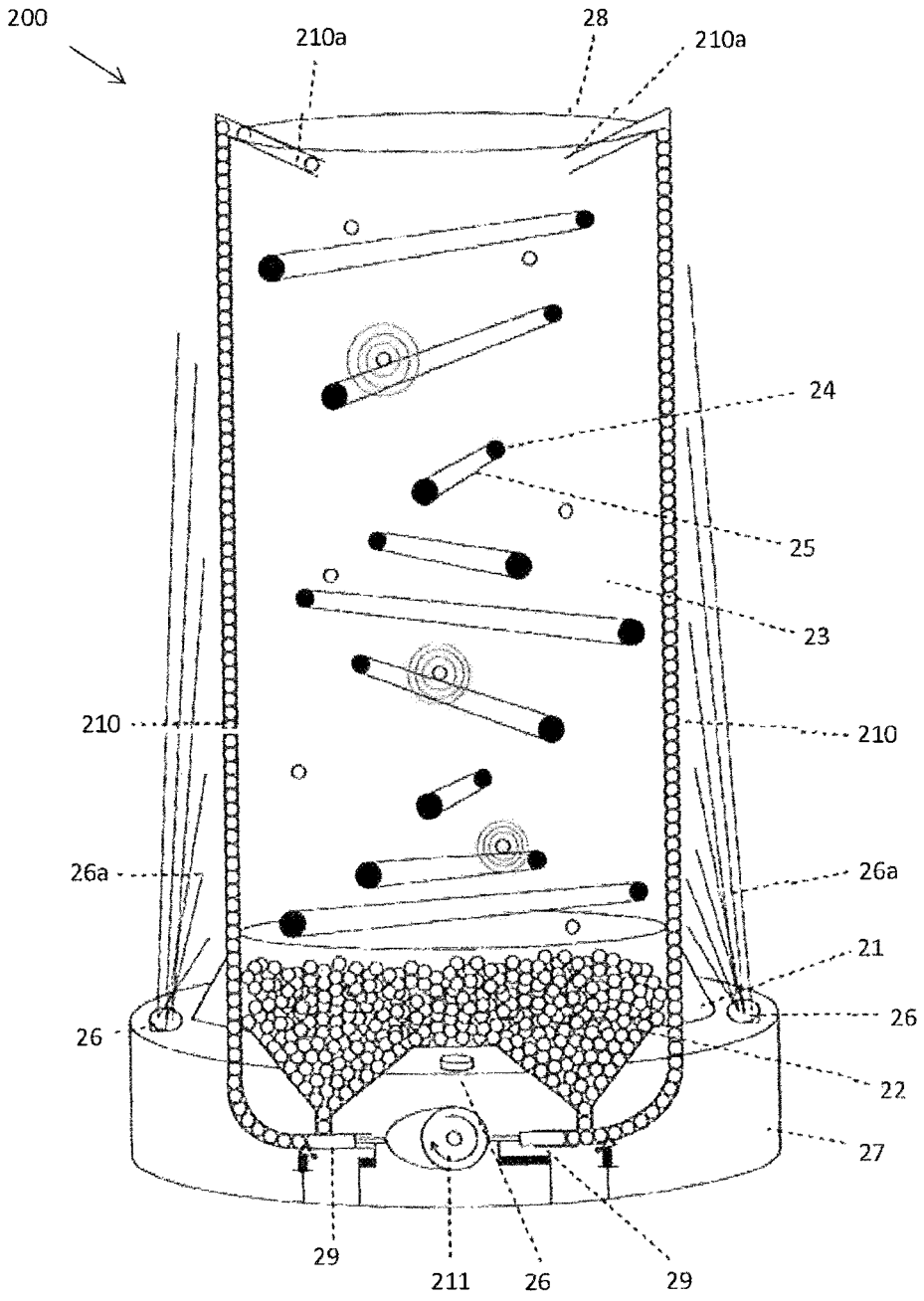
FIG. 4 shows a sectional view of an alternative embodiment of the present invention in the form of a musical sound generator.

FIG. 4 shows a cross section view of an alternative embodiment of the present invention, in which a musical sound generator according to the alternative embodiment is generally indicated by arrow 200. The apparatus (200) continuously produces random musical notes of a good tonal quality over an extended period of time without human intervention and is powered by a mains electricity source (not shown).

The musical sound generator (200) comprises a reservoir (21) at the bottom of the apparatus (200) and configured to hold a number of solid objects in the form of plastic beads (22); a resonant cavity (23) comprising a plurality of sound producing chimes in the form of bars (24) and sprung strings (25) configured to produce an audible sound when the plastic beads (22) impact on at least one of the strings (5).

The apparatus (200) includes at least one light emitting diode (LED; 26) integrated into a base (27) and configured to illuminate (26A) the exterior body (28) and/or act as a lamp. The bars (24) and strings (25) may optionally have an associated electronic circuit (not shown) configured to illuminate the LED's (26) when a string (25) is struck by the beads (22).

The musical sound generator (200) also comprises a transfer mechanism comprising a pair of actuators in the form of pistons (29) which are spring-loaded (29*a*) and are configured to push the beads (22) up a pair of tubes (210) to the top of the resonant cavity (23), wherein the beads fall down from the open end of each tube (210*a*) to the bottom of the resonant cavity (23) by gravity, to strike the strings (25) to generate a continuous cycle of musical sounds at random intervals over time. The pair of pistons (29) are activated by an electric motor (211) driven from an electricity supply (not shown).

The apparatus includes a retaining clip associated with each tube (210) configured to prevent the beads (22) from falling back down the tubes (210) to relief load on the pistons (29) and improve efficiency of the transfer mechanism.

The apparatus (200) also includes a lid (not shown) configured to fit over the top end of the resonant cavity (23) to prevent debris such as dust falling in.

The exterior body (28) of the apparatus (200) could be styled in an aesthetically pleasing form in different materials such organic wood or more modern Perspex. For example a clear exterior cover would show the internal movement and workings within the device which would add to the calming effect of the apparatus (200) by stimulating visual interest in the user.

The apparatus (200) may optionally comprise a microphone (not shown) positioned in the resonant cavity to transduce sound to be uploaded and reproduced via at least one speaker (not shown). The apparatus (200) may also optionally comprise a means to adjust the acoustic sound produced, such as the volume and/or sound effects such as reverberation and/or delay. This microphone may optionally have an associated electronic circuit (not shown) configured to illuminate the LED's (26) when sound is reproduced by the at least one speaker. In addition, the musical sound generator (200) may optionally comprise an ornamental water display selected from the group consisting of: a fountain, pool, cascade, waterfall, and stream. The apparatus (200) could be sold as a complete unit or as a kit of parts for easy assembly into the apparatus (200).

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

Aspects of the present invention have been described by way of example only and it should be appreciated that modifications and additions may be made thereto without departing from the scope thereof.

The invention claimed is:

1. A musical sound generator comprising:

a tube defining a resonant cavity, the tube comprising a plurality of sound producing chimes configured to produce an audible sound when at least one object impacts on at least one of the chimes;

a reservoir configured to hold a number of objects;

a transfer mechanism configured to transfer the objects from the reservoir to an elevated position within the resonant cavity;

a power source; and loading assistance means powered by the power source and configured to assist the uptake of the objects of the transfer mechanism from the reservoir, wherein the objects fall down from the elevated position within the resonant cavity by gravity after being transferred by the transfer mechanism, to strike the plurality of sound producing chimes to generate a continuous cycle of musical sounds at random intervals over time.

2. The musical sound generator of claim 1, wherein the objects are plastic beads.

3. The musical sound generator of claim 1, wherein the transfer mechanism is a driven belt configured with a plurality of paddles to capture and transfer the objects to the top of the tube.

4. The musical sound generator of claim 1, wherein the tube is configured to rotate via a motor.

5. The musical sound generator of claim 1, wherein the loading assistance means is configured to move the position of the reservoir in relation to the transfer mechanism depending on the level of the objects held in the reservoir to assist the uptake of the objects of the transfer mechanism from the reservoir.

6. The musical sound generator of claim 1, wherein the power source is an electrical power source.

7. The musical sound generator of claim 6 wherein the loading assistance means is configured to move the position of the reservoir in relation to the transfer mechanism with at least one sensor configured to sense the level of the objects in the reservoir and at least one actuator configured to move the position of the reservoir via input from the at least one sensor.

8. The musical sound generator of claim 6, wherein the loading assistance means is configured to cause the objects to be attracted to the transfer mechanism.

9. The musical sound generator of claim 6, wherein the loading assistance means is configured to agitate the objects in the reservoir.

10. The musical sound generator of claim 6, wherein the loading assistance means comprises an ion generator configured to produce electrostatic charge to one or more of the objects and/or the reservoir.

11. The musical sound generator of claim 1, wherein the musical sound generator also comprises a microphone positioned in the resonant cavity to transduce sound to be uploaded and reproduced via at least one speaker.

12. The musical sound generator of claim 1, wherein the musical sound generator also comprises at least one LED configured to illuminate the resonant cavity when one of the chimes is struck by one of the objects.

* * * * *